United States Patent [19]

Matura

[11] 4,094,245

[45] June 13, 1978

[54] PARACHUTE FLARE HAVING A VARIABLE BURN RATE

[75] Inventor: Joseph R. Matura, Ironia, N.J.

[73] Assignee: The United States of America as represented by the Secretary of the Army, Washington, D.C.

[21] Appl. No.: 793,007

[22] Filed: May 2, 1977

[51] Int. Cl.[2] ..... F42B 4/28

[52] U.S. Cl. ..... 102/35; 102/37.8; 102/101; 102/103

[58] Field of Search ..... 102/35, 37.8, 101, 103

[56] References Cited

U.S. PATENT DOCUMENTS

| | | | |
|---|---|---|---|
| 3,051,085 | 8/1962 | Finkelstein | 102/37.8 |
| 3,605,624 | 9/1971 | Dinsdale et al. | 102/103 |
| 3,895,578 | 7/1975 | Shaw et al. | 102/37.8 |
| 3,942,442 | 3/1976 | Advokat | 102/35 |

FOREIGN PATENT DOCUMENTS

| | | | |
|---|---|---|---|
| 1,026,162 | 4/1966 | United Kingdom | 102/37.8 |

*Primary Examiner*—Verlin R. Pendegrass
*Attorney, Agent, or Firm*—Nathan Edelberg; Harold H. Card, Jr.; A. Victor Erkkila

[57] ABSTRACT

A variable burn rate/variable burn time parachute flare, adapted to be transported by a gun cannon or howitzer to a desired height and then ignited to burn at an intensity of 1.6 to 1.8 $\times$ $10^6$ candlepower for 25 to 35 seconds, followed by a second burn at about 0.8 $\times$ $10^6$ candlepower for 75 to 35 seconds and comprising a flare case having a hollow cylindrical wall about 4.5 inches in diameter and about 7 inches long, closed at one-end and open at the other end, and a 0.03 inch coating of polyester or epoxy resin on the closed end and on one-third to two-thirds of the inner wall thereof adjacent to the closed end.

8 Claims, 3 Drawing Figures

PARACHUTE FLARE HAVING A VARIABLE BURN RATE

GOVERNMENTAL INTEREST

The invention described herein may be manufactured, used and licensed by or for the Government for governmental purposes without the payment to me of any royalty thereon.

BACKGROUND AND SUMMARY OF THE INVENTION

The invention relates to parachute flares, or flare candles, for illuminating projectiles, such as the conventional M485, 155mm illuminating projectile which is launched by a 155mm howitzer cannon toward a distant enemy area and initiated at a burst height of about 600 meters (M) to eject the parachute flare to burn during its parachute descent.

Normally, such flares contain a single conbustible formulation, resulting in a uniform burn rate and candlepower output. Since the illumination, in foot-candles, on a ground target varies inversely as the square of the distance from the light source, the ground illumination during a large part of the burn is insufficient for proper observation. The problem originates because of the necessity to maintain a relatively long burn time. Since the rate of fall or descent of the parachute and flare is nearly constant, at about 14 ft./sec., this requirement leads to higher burst heights, which require higher intensity (candlepower) flares. If the intensity is sufficient to provide adequate illumination during the first part of the burn, it is far higher than necessary during the last part of the burn, and hence inefficient.

Tests have shown that the flare for the original M485 illuminating projectile, which is a hollow metal or paper cylinder having a length of about 4.5 inches, open at end and closed at the other end and filled with a single flare composition of 52% Mg, 40% $NaNO_3$ and 8% polyester resin binder, when ignited, burns at an intensity of about 3,500,000 C.P. for only about 45 seconds. With a descent rate of 14 ft./sec., the flare will descend about 630 feet in this time. If the flare shell is initiated at a height of 300 M (984 feet), the ground illumination at the start of the burn is $$E = \frac{I}{h^2} = \frac{3.5 \times 10^6}{(984)^2} = 3.6 \text{ foot candles,}$$

and the ground illumination is $$E = \frac{I}{h^2} = \frac{3.5 \times 10^6}{(984 - 630)^2} = 27.9 \text{ foot candles.}$$

Currently, particularly in metal case applications, the interior walls of the flare case or cylinder are coated, before filling, with a minimum prescribed thickness of a resin material, such as polyester of epoxy resin, which acts as an inhibitor/insulator, reducing the burn rate and increasing the burn time. This has also been done with flares using paper-cardboard cases. The effectiveness of the resin coating is a function of its thickness. When the flare case of the M485 illuminating projectile is provided with such a resin coating having a thickness of 0.03 inch before filling with the illuminating composition, the flare burns at an intensity of about 800,000 C.P. for about 120 second. If the burst height is 600 M (1968 feet) the ground illumination is about 0.2 foot candle at the start, and about 9.6 foot candles at the end of the burn. Although the burn time (120 seconds) is adequate and the initial illumination is equal to the normal requirement of at least 0.2 foot candle of ground illumination, the final illumination is much higher than necessary.

Recent efforts have been directed toward a variable burn rate flare. One method is to consolidate a candle (flare) with three different formulations. The first increment is an extremely rapid formulation delivering the greatest candle power output or intensity at the height of the burn (the greatest distance from the target); the second and third increments are formulations of decreasing burn rate for use in succession as the candle descends closer to the target. This method is very expensive to carry out and control since the three formulations must be integrated, and would be a production bottleneck in any automated system of manufacturing flares.

In accordance with the present invention, a variable burn rate/variable burn time flare is produced by coating only a predetermined portion of the inner case wall, at the closed end, with a thin layer, e.g. 0.03 inch thick, of a polyester or epoxy resin, leaving the remaining portion of the wall at the open end bare; and then filling the case with a single illuminating formulation. When the flare is ignited, at any desired height, the portion of the flare composition located within the bare open portion of the case wall burns for a first period of time at a rate that is about midway between the burn rates for a completely bare flare case and a fully coated flare case, and then burns for a second period of time at about the same rate as a fully coated flare. Preferably, the flare is designed and the burst height is chosen so that the total burn time is equal or nearly equal to the time of descent of the parachute flare. The burn rates and burn times are adjusted by adjusting the fraction of the case wall that is coated. The outer edge of the coating may be tapered in thickness to produce a gradual transition between the coated and bare portions. Several examples are given, with different fractional coatings and different burst heights.

DETAILED DESCRIPTION OF PREFERRED EMBODIMENTS

Figure 2:
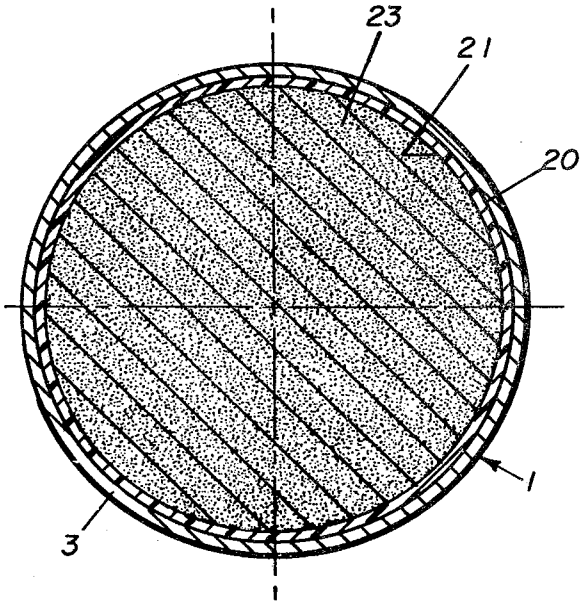
FIG. 2 is a transverse section view taken on line 2—2 of FIG. 1.
Figure 1:
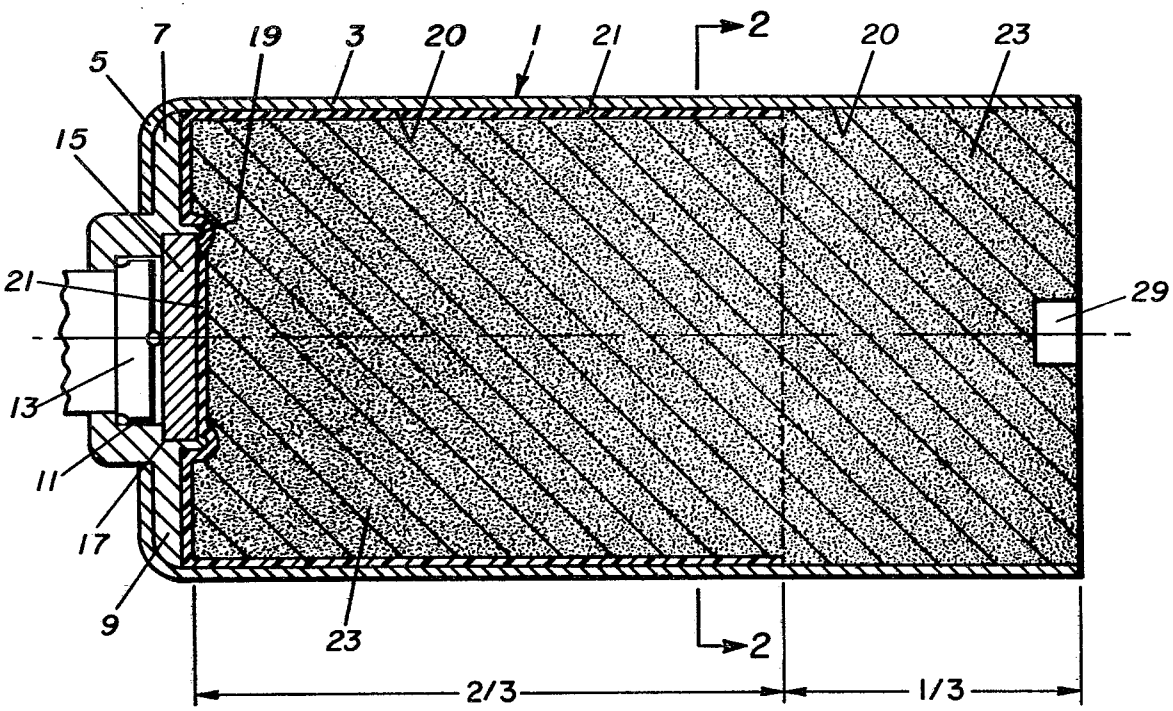
FIG. 1 is an axial longitudinal section view of a parachute flare embodying the present invention, taken on line 1—1 of FIG. 2.

FIGS. 1 and 2 show a parachute flare case 1, for a conventional M485, 155mm illuminating projectile, modified to illustrate one embodiment of the invention. Case 1 is a cylindrical cup comprising a cylindrical side wall 3, having a length of about 7 inches and an inside diameter of about 4.5 inches, and an inturned flange 5. The base of the cup is formed by an annular plate 7 having an outer periphery 9 seated in the flange 5 and a flanged central aperture 11 in which a headed parachute connector 13 is swiveled. The connector 13 is held in place by a disc 15 fixed within an enlarged portion 17, as by peening at 19. In the M485 projectile the other end of the parachute connector 13 is connected to the shrouds of a flare parachute which, with the flare case 1, is packed within an outer housing of the projectile (not shown) and ejected therefrom at the desired burst height.

The flare case 1 described thus far is usually filled with the flare composition either in contact with the entire inner surface 20 thereof, or separated from the case wall by a resin coating over the entire inner surface 20. When ignited at a desired height, the uncoated flare burns at a high burn rate of about $3.5 \times 10^6$ candle power for only about 45 seconds. On the other hand, the fully coated flare burns at a low burn rate of about $0.8 \times 10^6$ candlepower for about 120 seconds.

In accordance with the present invention, in order to provide a variable intensity/variable burn flare, a predetermined fraction of the inner surface of the case 1, at the inner end thereof, is first coated with a thin layer of polyester or epoxy resin. For example, the closed end and the adjacent two-thirds of the inner surface 20 of the case 1 in FIG. 1 is coated with a 0.03 inch layer 21 of polyester resin, leaving the other one-third of the surface bare, and then the case 1 is completely filled with a uniform mass 23 of flare composition, e.g., a composition consisting essentially of 52% Mg, 40% $NaN0_3$, and 8% polyester resin binder. The flare is provided with a conventional igniter centrally located in the composition at the open end of the flare case 1, for igniting the composition at the desired time.

It was assumed that the initial burn rate of the outermost part of the composition, that was in comtact with the case wall 1, would be substantially the same as that for an uncoated flare. However, a flare as shown in FIG. 1 burned first for about 25 seconds at a burn rate of intensity of about $1.6 \times 10^6$ candlepower, or less than one-half that of the uncoated flare, followed by a burn for 75 seconds at a burn rate of $0.8 \times 10^6$ candlepower, as expected. The total burn time of 100 seconds is large comparted to the 45 seconds for an uncoated flare and not much less than the 120 seconds for the fully coated flare.

Figure 3:
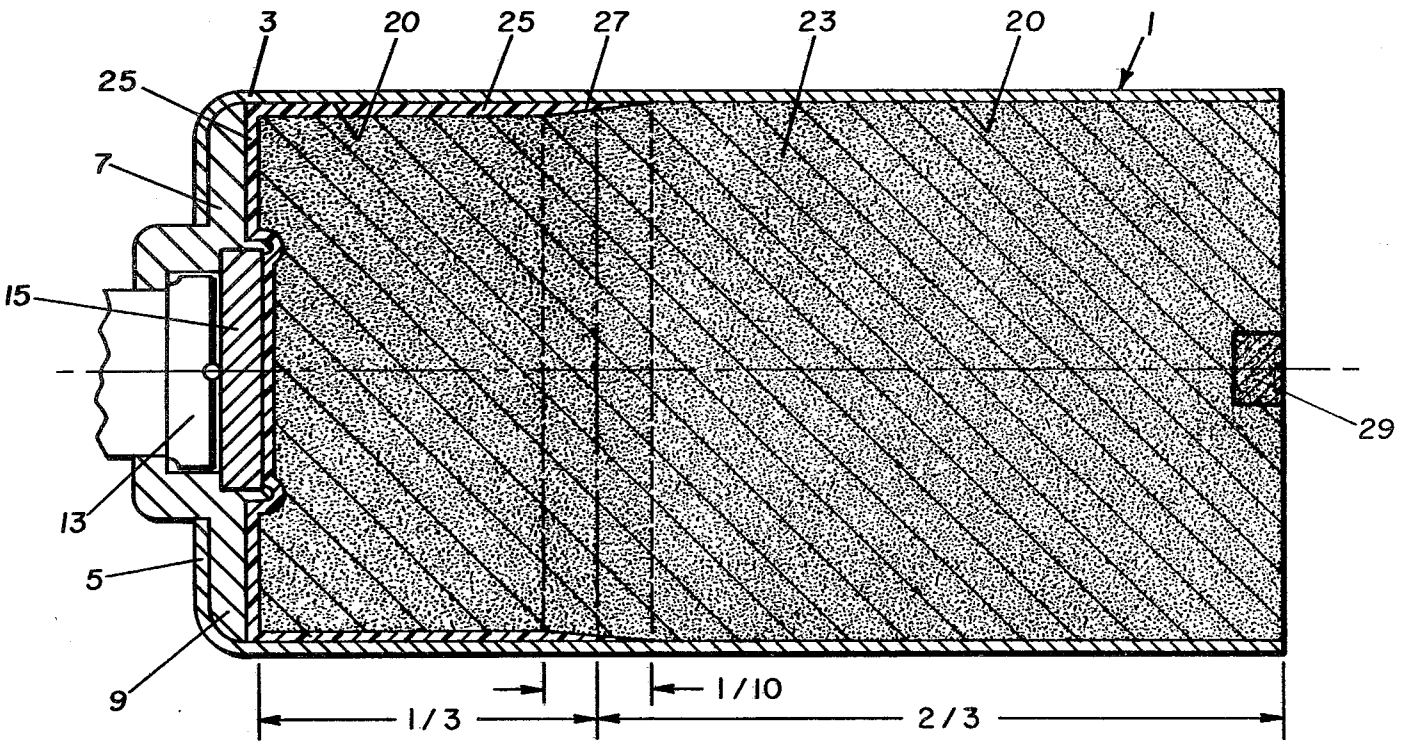
FIG. 3 is a view similar to FIG. 1 of a different embodiment of the invention.

FIG. 3 shows another embodiment of the invention, wherein a flare 1, identical to that of FIG. 1 and 2, is internally coated on the closed end and on about the first one-third of the adjacent side wall, or surface 20, with a 0.03 inch thick layer 25 of polyester resin. Moreover, the outer edge of the resin layer 25 may be tapered in thickness down to a feather edge, as shown at 27, to produce a gradual transition between the coated and bare portions of the flare. A flare as shown in FIG. 3 with the inner third of the wall 20 coated with the resin layer 25, but without the tapered edge, burned first for about 35 seconds at a burn rate of about $1.8 \times 10^6$ candlepower, and then burned for about 35 seconds at a burn rate of about $0.8 \times 10^6$ candlepower.

Either of the two flares shown in FIGS. 1 and 3 can be launched by a gun cannon to any desired burst height, at which altitude the flare is ignited. The ground illumination E produced, in a clear atmosphere, by the flare of intensity I at any height $h$ is determined from the formula $E = I/h_2$ footcandles. The following tables I and II include the calculated values of ground illumination E at the beginning and end of each burn time for and $\frac{1}{3}$ - coated flares, respectively, ignited at various altitudes from 400 to 900 meters:

TABLE I

2/3 COATED FLARE

| ALTITUDE (meters-feet) | DESCENT TIME (Seconds) | INTENSITY ($\times 10^6 \times$ C.P. | BURN TIME (Seconds) | ILLUMINATION (Foot Candles) |
|---|---|---|---|---|
| 400 1312 | | 1.6 | 0 | .93 |
| 962 | | 1.2 | 25 | 1.3 |
| 0 | 94 | .8 | 75 | — |
| 500 1640 | | 1.6 | 0 | .57 |
| 1290 | | 1.2 | 25 | .72 |
| 240 | 117 | .8 | 75 | 13.9 |
| 600 1968 | | 1.6 | 0 | .40 |
| 1618 | | 1.2 | 25 | .46 |
| 568 | 141 | .8 | 75 | 2.5 |
| 700 2297 | | 1.6 | 0 | .30 |
| 1897 | | 1.2 | 25 | .31 |
| 1547 | 164 | .8 | 75 | .99 |
| 800 2625 | | 1.6 | 0 | .23 |
| 2275 | | 1.2 | 25 | .23 |
| 1225 | 188 | .8 | 75 | .53 |

TABLE II

| ALTITUDE (meters-feet) | DESCENT TIME (seconds) | INTENSITY ($\times 10^6 \times$ C.P.) | BURN TIMES (seconds) | ILLUMINATIONS (foot candles) |
|---|---|---|---|---|
| 400 1312 | | 1.8 | 0 | 1.05 |
| 962 | | 1.3 | 35 | 1.92 |
| 0 | 94 | .8 | 35 | 7.26 |
| 500 1640 | | 1.8 | 0 | .67 |
| 1290 | | 1.3 | 35 | .98 |
| 240 | 117 | .8 | 35 | 1.84 |
| 600 1968 | | 1.8 | 0 | .46 |
| 1618 | | 1.3 | 35 | .60 |
| 568 | 141 | .8 | 35 | .82 |
| 700 2297 | | 1.8 | 0 | .34 |
| 1897 | | 1.3 | 35 | .40 |
| 1547 | 164 | .8 | 35 | .46 |
| 800 2625 | | 1.8 | 0 | .26 |
| 2275 | | 1.3 | 35 | .28 |
| 1225 | 188 | .8 | 35 | .30 |
| 900 2953 | | 1.8 | 0 | .21 |
| 2463 | | 1.3 | 35 | .21 |
| 1973 | 211 | .8 | 35 | .21 |

The descent times in Table I and II are based on a descent rate of 14 feet/ second. The average of the two intensities is taken as the intensity at the intermediate altitude, in each table, as for example, the value $1.2 \times 10^6$ CP in Table I.

As shown in Table I, the $\frac{2}{3}$ - coated flare ignited at 400 meters lands before the end of the 75 second burn; thus, the minimum burst height for that flare should be at least $94 \times 14 = 1316$ feet. The maximum burst height is determined by the minimum ground illumination desired. The tables show that, if the burst height is sufficiently high, the ground illuminations can be made substantially the same at the three altitudes given.

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

What is claimed is:

1. A parachute flare having a variable burn rate comprising:

an elongated container having a closed end and an open end;

a thin liner of uniform burn-inhibiting, heat-insulating material coating the inner surface of said closed end and at least the first third of the inner side wall of said container, starting at said closed end; with the opposite end of said liner spaced substantially from said open end to leave a substantial bare area of said side wall adjacent to said open end;

a mass of substantially-iniform, combustible, illuminating material completely filling said container and in contact with said liner and said bare area; and means for igniting said illuminating material at said open end;

whereby said flare can be transported to a given altitude over an area to be illuminated, where it is ignited and burns at a given intensity for a first predetermined time, during a first portion of its fall, and then burns at a substantially lower intensity for a second predetermined time, during a second portion of its fall.

2. A flare as in claim 1, wherein said liner is a polyester or epoxy resin, and said illuminating material has a composition consisting essentially of 52% mg, 40% $NaNO_3$, and 8% polyester resin binder;

3. A flare as in claim 1, wherein said container is a thin-walled cylindrical cup having a length-to-diameter ratio of at least 2.

4. A flare as in claim 1, wherein said liner extends along about one-third to two-thrids of the length of said side wall.

5. A flare as in claim 4, wherein said side wall has a diameter of about 4.5 inches and a length of about 7 inches, said liner has a constant thickness of about 0.03 inch and extends along about two-thirds of the length of said side wall; whereby said flare burns first with an intensity of about 1,600,000 candle power for about 25 seconds, followed by a second burn with an intensity of about 800,000 candlepower for about 75 seconds.

6. A flare as in claim 4, wherein said side wall has a diameter of about 4.5 inches and a length of about 7 inches, said liner has a constant thickness of about 0.03 inch and extends along about one-third of the length of said side wall; whereby said flare burns first with an intensity of about 1,800,000 candlepower for about 35 seconds, followed by a second burn with an intensity of about 800,000 candlepower for about 35 seconds.

7. A flare as in claim 1, wherein said other end of said liner has a tapered thickness edge.

8. A flare as in claim 7, wherein said liner extends along about one-third of the length of said side wall.

* * * * *